United States Patent [19]

Huttle

[11] Patent Number: 4,991,273

[45] Date of Patent: Feb. 12, 1991

[54] SHOELACE FASTENINGS, AND SHOES AND SNEAKERS INCLUDING THE SAME

[76] Inventor: Carolyn J. Huttle, 78 Southview Dr., Berkeley Heights, N.J. 07922

[21] Appl. No.: 383,605

[22] Filed: Jul. 24, 1989

[51] Int. Cl.[5] ..... A43C 1/00

[52] U.S. Cl. ..... 24/712.1; 24/715.3

[58] Field of Search ..... 24/117 R, 119, 140, 24/143 A, 300, 301, 3 C, 116 A, 616, 115 H, 115 J; 446/26, 27, 28; 36/100, 136

[56] References Cited

U.S. PATENT DOCUMENTS

| | | | |
|---|---|---|---|
| 58,364 | 10/1866 | Adams . | |
| 111,625 | 2/1871 | Ford . | |
| 125,400 | 4/1872 | Lawson . | |
| 146,913 | 1/1874 | Keith . | |
| 155,156 | 9/1874 | Henry | 24/117 R |
| 215,286 | 5/1879 | Noack . | |
| 341,004 | 5/1886 | Hayden . | |
| 578,066 | 3/1897 | Munsell . | |
| 667,175 | 2/1901 | Atkinson | 24/117 R |
| 697,590 | 4/1902 | Wright . | |
| 705,356 | 7/1902 | Jordan . | |
| 767,891 | 8/1904 | Isakson . | |
| 901,353 | 10/1908 | LaFond . | |
| 1,062,511 | 5/1913 | Short . | |
| 1,172,954 | 2/1916 | Derrenberger . | |
| 1,358,753 | 11/1920 | Killam et al. . | |
| 1,522,297 | 1/1925 | Godsol | 24/116 A |
| 1,531,410 | 3/1925 | Osterholt | 24/117 R |
| 1,667,276 | 4/1928 | Weingarten . | |
| 1,669,537 | 5/1928 | Schaffer . | |
| 1,740,506 | 12/1929 | Grosser . | |
| 1,767,732 | 6/1930 | Breadon . | |
| 1,772,673 | 8/1930 | MacDonald . | |
| 1,775,013 | 9/1930 | Yugawa . | |
| 1,848,318 | 3/1932 | Ciampi . | |
| 1,862,047 | 6/1932 | Boulet et al. . | |
| 1,907,629 | 5/1933 | Walty . | |
| 2,004,702 | 6/1935 | Luttmann, Jr. . | |
| 2,650,399 | 9/1953 | Torelli | 24/117 R |
| 3,168,769 | 2/1965 | Smith . | |
| 3,208,164 | 9/1965 | Hoyt, Jr. | 24/117 R |
| 3,358,338 | 12/1967 | Clasen | 24/117 R |
| 3,453,697 | 7/1969 | Berzeny, Sr. | 24/115 H |
| 3,473,198 | 10/1969 | Meier | 24/120 |
| 3,701,572 | 10/1972 | Velasquez . | |
| 4,290,172 | 9/1981 | Burton | 24/117 R |
| 4,777,705 | 10/1988 | Ingram | 24/143 A |
| 4,790,048 | 12/1988 | Arnt . | |

FOREIGN PATENT DOCUMENTS

| | | | |
|---|---|---|---|
| 192804 | 11/1957 | Austria | 24/117 R |
| 1286791 | 1/1962 | France | 24/117 R |
| 80351 | 3/1963 | France | 24/117 R |
| 82372 | 9/1953 | Norway | 24/117 R |

*Primary Examiner*—Victor N. Sakran

*Attorney, Agent, or Firm*—Mathews, Woodbridge & Collins

[57] ABSTRACT

A kit comprising elastic laces and decorative fastenings therefor to be applied to conventional shoes and sneakers, and conventional shoes and sneakers including elastic laces and decorative fastenings.

3 Claims, 5 Drawing Sheets

SHOELACE FASTENINGS, AND SHOES AND SNEAKERS INCLUDING THE SAME

BACKGROUND OF THE INVENTION

This relates in general to shoelace fastenings, and more particularly to decorative fastenings, including elastic laces, which may be sold in novelty shops in the form of a kit, for use with conventional shoes and sneakers. This invention also relates to conventional shoes and sneakers using decorative fastenings including elastic laces.

Shoelaces have a tendency to loosen, or to become untied, which makes the wearer look sloppy.

In the prior art, it has been well-known for many years to use elastic laces in shoes and sneakers, and to use various devices for locking the laces in place. However, there is no product presently available on the market which enables individuals to install in their own shoes elastic laces with decorative locking devices.

It is therefor the primary object of this invention to provide improved shoe fastenings. More particular objects of this invention are to provide fastenings which can be readily installed by the user, and which are maintained in place without being repeatedly fastened. Another object of this invention is to provide fastenings which enhance the appearance of the shoe.

These and other objects are realized in the present invention which comprises a kit with an elastic lace and fasteners therefor adpated to be purchased on the market and installed by the user in shoes or sneakers to keep them permanently laced without being repeatedly laced and tied. In addition to the elastic lace, each kit comprises a pair of locking devices, which may or may not be matched, through which each of the ends of the elastic lace is constructed to be threaded, and means, such as a ring or bead, for securing each of the ends in place. The locking devices may take different forms. In one embodiment, each of the locking devices may take the form of an elongated bead of general cylindrical shape with an opening drilled through the center in an axial direction, and one or more smaller beads adjacent each of its ends, with a final bead or ring to be knotted against the outer end of the opening so that the knot is concealed in the opening. Another embodiment may comprise a pair of flat disks, which may or may not be matched, one for each end of the lace, through the center of each of which, one or two openings have been drilled, and through each of which disks, the lace is adapted to be threaded and secured, by knotting against the underside of the disk. Still another embodiment may comprise a pair of flat disks each having one or more openings for threading through the ends of the respective laces, and one or more beads or rings for securing the end of the lace against the under face of the disks. Each of the disks may be in the form of an animal or other decorative symbol.

The user, after purchasing the product, laces up the shoe and draws the ends of the laces through the openings in each of the locking devices, knotting the end, or securing the ends by knotting through a ring or bead adjacent the under face of the locking device. Thus, the shoe or sneaker, with the elastic lace and locking devices in place, can be pulled on and off without relacing. This provides great convenience for the user. Furthermore, the locking devices, which may be in many different forms, serve as decorations for the shoes.

It is contemplated that in addition to purchasing a kit for applying the elastic laces and decorative fastenings to shoes or sneakers already owned, a potential user may purchase shoes or sneakers in which the decorative fastenings and elastic laces have already been installed.

These, and other objects, features and advantages will be better understood from a study of the attached drawings with reference to the detailed description hereinafter.

SHORT DESCRIPTION OF THE DRAWINGS

DETAILED DESCRIPTION OF THE INVENTION

Figure 1A:
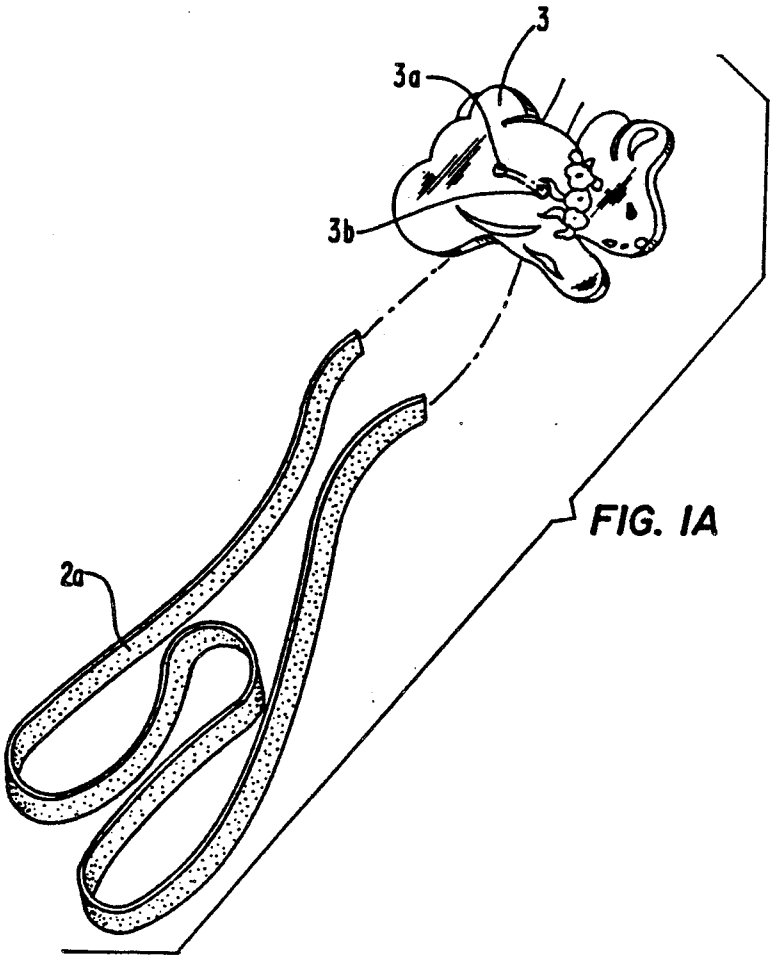
FIG. 1A shows the lace and locking device for one shoe removed from the package of FIG. 1.
Figure 1:
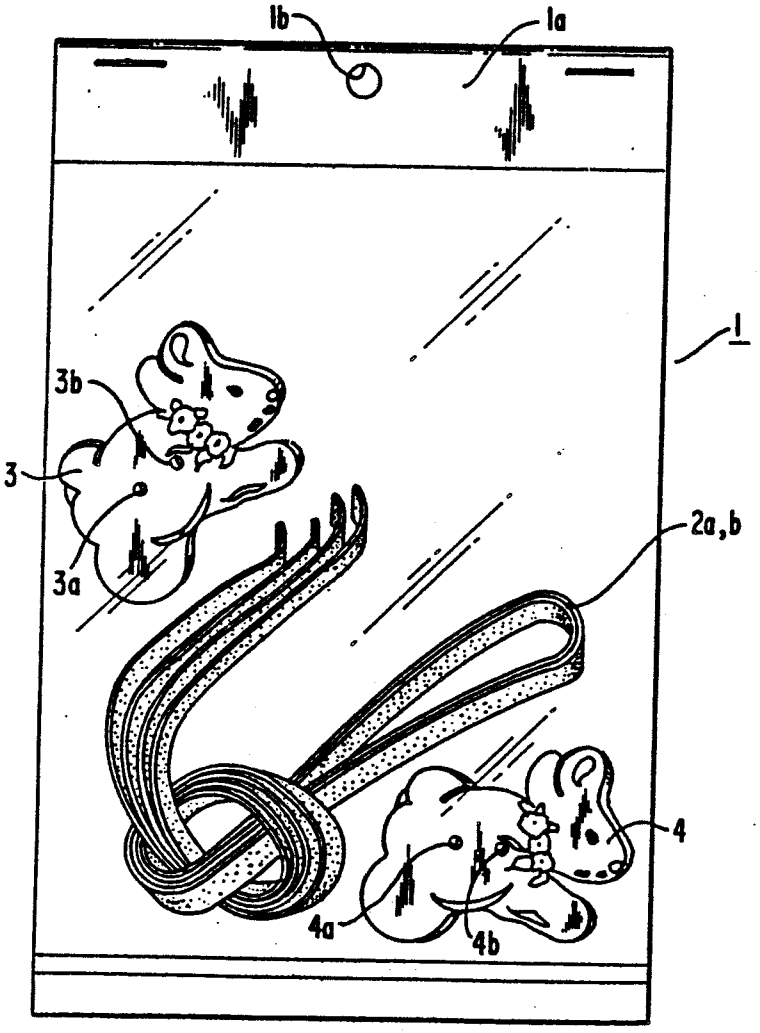
FIG. 1 shows a kit containing an assemblage of the elements of one embodiment of the invention.

Referring to FIG. 1, there is shown a package 1 which may, for example, comprise two layers of transparent flexible plastic, such as low density polyethylene, rectangular in shape, say, 6¾ inches long and 4 inches wide, closed at the bottom and sides and sealed across the top with a seal 1*a*, at the center of which may be a round perforation 1*b* for hanging the bag for display purposes. It will be understood that the size and shape of the package 1 may be varied in accordance with the size and shape of the enclosed pieces.

Figure 4:
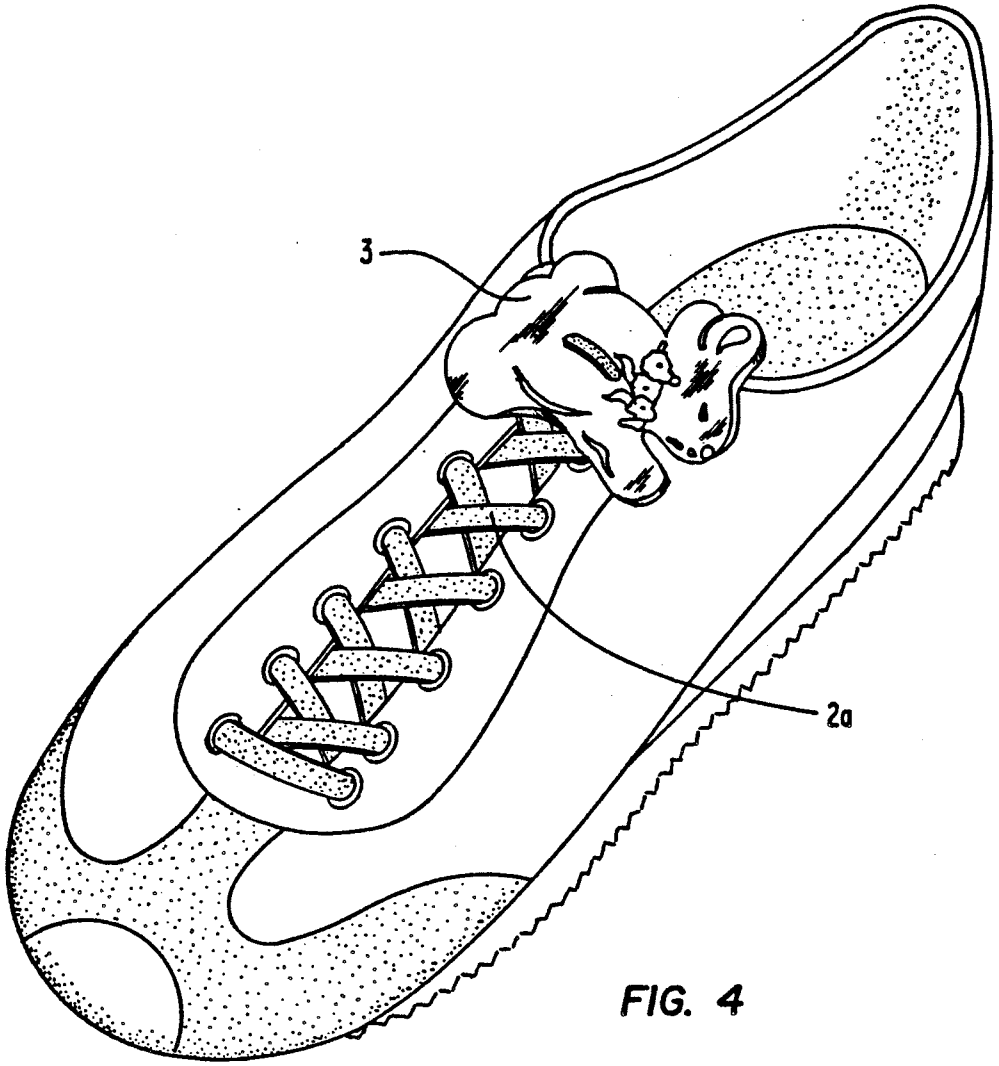
FIG. 4 shows the elements of FIG. 1 installed in one of a pair of conventional sneakers.

Enclosed in the package 1 are a pair of conventional elastic shoelaces 2*a*, 2*b*, say, ¼ inch wide and, say, 2½ feet long. Also, enclosed are a pair of flat rigid decorative members 3 and 4 of wood, plastic, pressed cardboard or other rigid material, say, 1½ inches long, 1 inch wide, and ⅛ inch thick. These may be identical, or different, in the form of animals, such as rabbits as shown, or may take the form of abstract shapes, such as hearts, stars, diamonds, etc. Near the center of each of the members 3 and 4 are drilled a pair of holes, 3*a*, 3*b* and 4*a*, 4*b*, about ⅛ inch in diameter and spaced-apart about ¼ inch, to accommodate the ends of the elastic shoelace, which are drawn through and knotted together on the underside of members 3 or 4 after the shoe has been laced up in the normal fashion. Thus, the shoelace has been secured in place, and need not be removed and relaced to enable the wearer to pull the shoe on or off. When installed on the wearer's shoe, this embodiment appears as shown in FIG. 4 of the drawings.

Figure 2A:
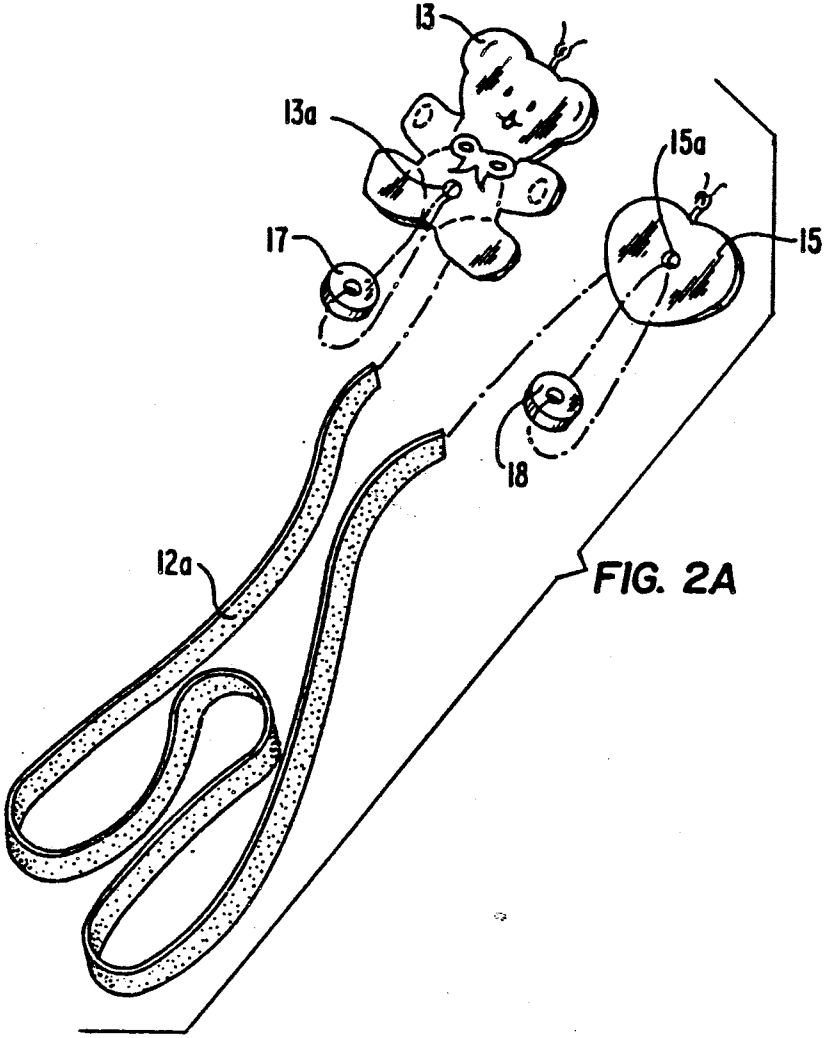
FIG. 2A shows the lace and locking devices for one shoe removed from the package of FIG. 2.
Figure 2:
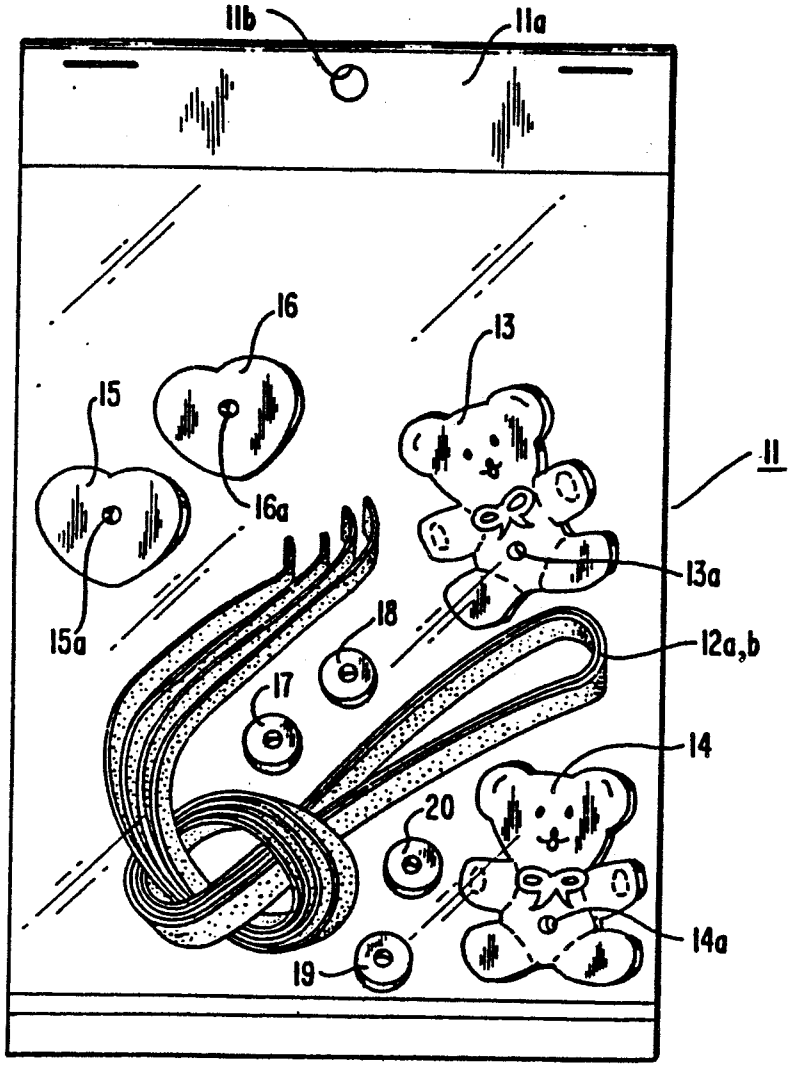
FIG. 2 shows a kit containing an assemblage of a second embodiment of the invention.

A second embodiment is shown in FIG. 2 which is sold in a sealed transparent package 11 which is similar to package 1 of FIG. 1. The contents for one shoe removed from package 11 are shown in FIG. 2A.

Figure 5:
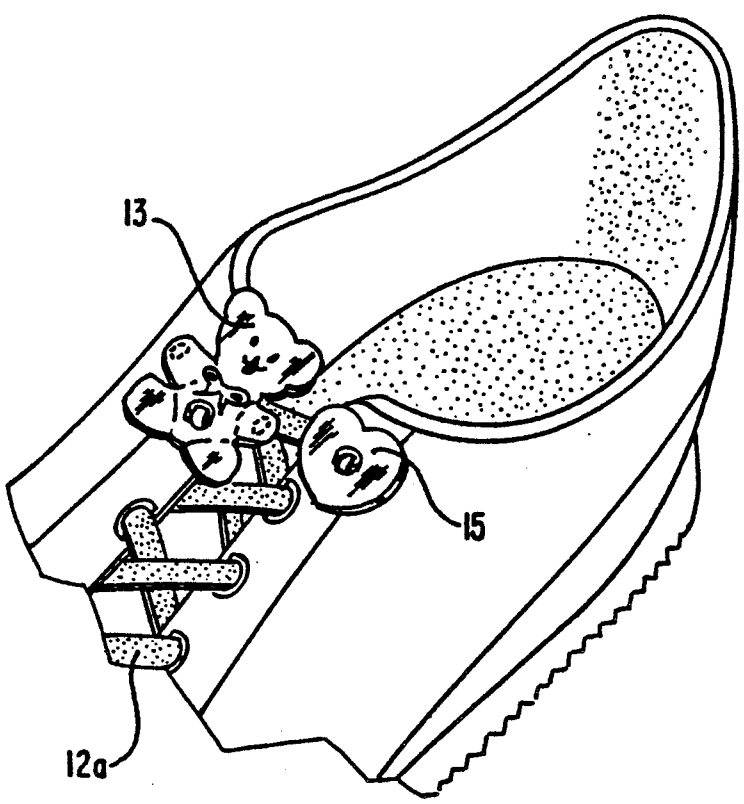
FIG. 5 shows the elements of FIG. 2 installed in one of a pair of conventional sneakers, partially broken away.

The package 11 includes a pair of elastic laces 12*a*, 12*b*, which maybe similar to the laces 2*a*, 2*b* of FIG. 1. Also enclosed are a first pair of flat, rigid decorative members 13 and 14, of wood, cardboard, plastic or similar rigid material, say, ⅛ inch thick, which may be, for example, 1½ inches long and 1 inch wide, in the present embodiment taking the form of teddy bears, each having a central perforation 13*a*, 14*a*, say, ⅛ inch in diameter. Also, enclosed are another pair of flat rigid decorative members 15 and 16, about ½ inch long and ½ inch wide, which may take the form of abstract shapes, such as hearts. Also, enclosed in package 11 are four cylindrical beads 17, 18, 19 and 20, which are ⅜ inch in outer diameter, ⅜ inch thick in an axial direction, and having an inner bore, say ⅛ inch in diameter. After each of the laces 12*a* and 12*b* are laced up in the normal manner in a respective shoe, the ends are secured separately, as shown in FIG. 2A and FIG. 5. For example, one end of 12 is drawn through the hole 13*a* from the underside of 13, looped through the bead 17, passed back through 13*a* and knotted on the underside of 13. The other end of lace 12*a* is similarly secured by drawing it through the hole 15*a* in the heart-shaped element 15 and looping it through bead 18. It is then passed back through 15*a* and knotted on the underside of 15. FIG. 5 shows the appearance when the sneaker is laced up. The lace 12*b* is similarly secured in the other sneaker using the decorative elements 14 and 16, and the rings 19 and 20.

Figure 3A:
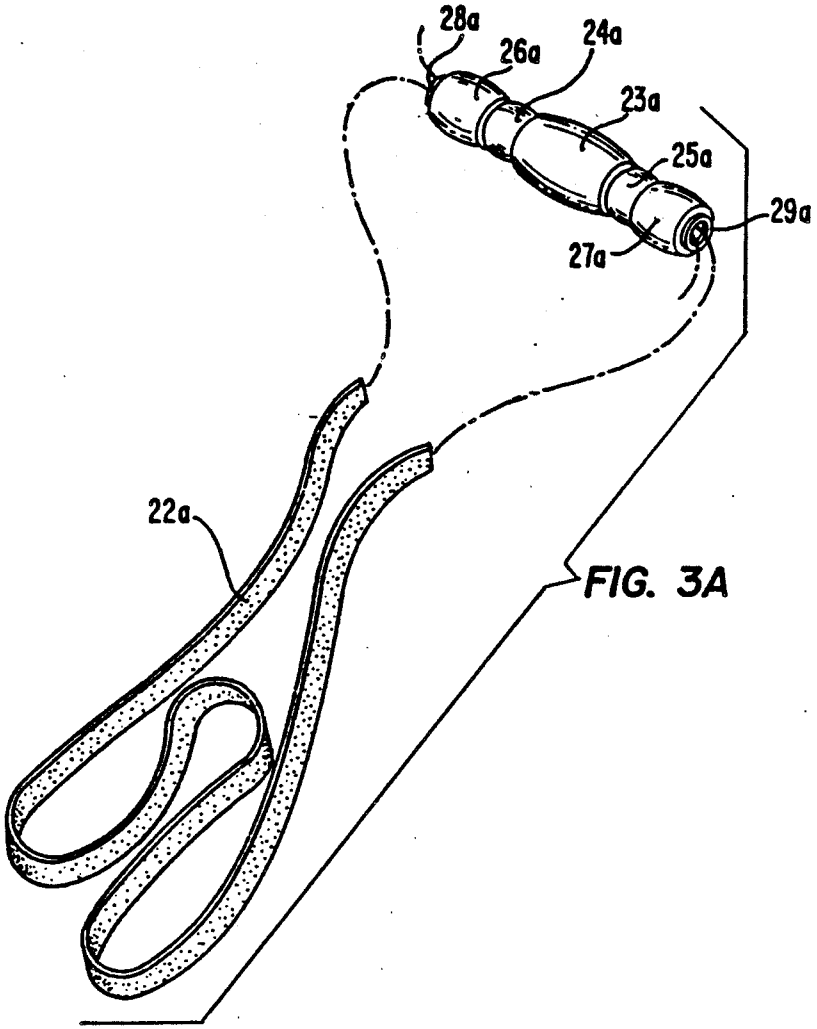
FIG. 3A shows the lace and locking devices for one shoe removed from the package of FIG. 3, and partially assembled.
Figure 3:
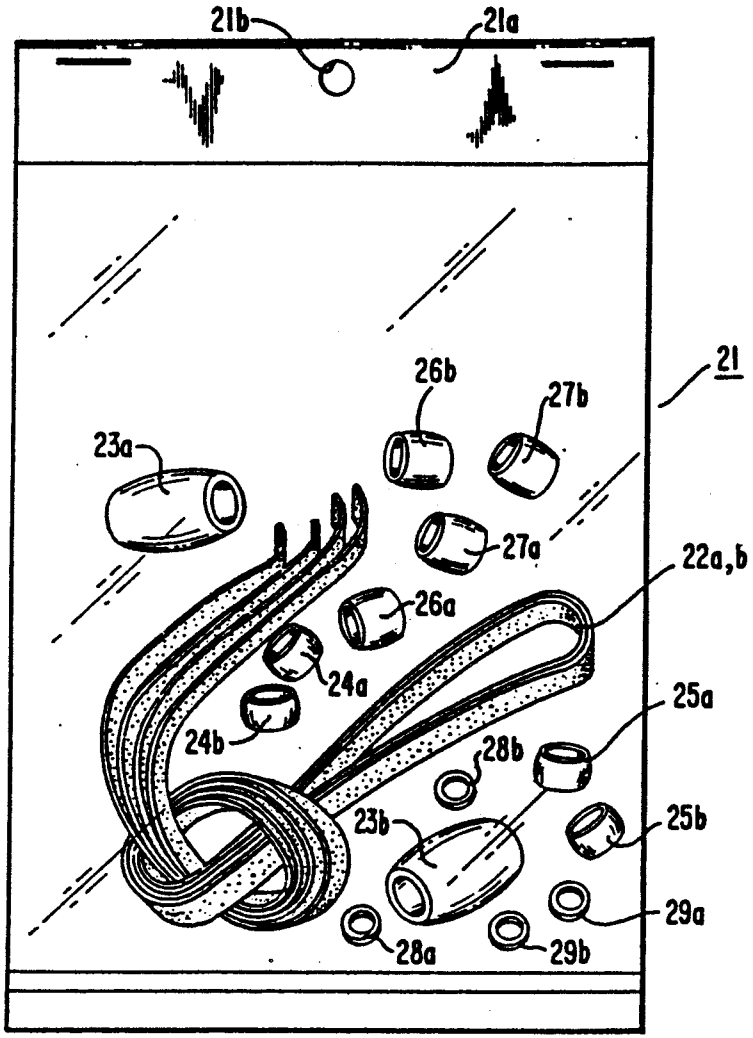
FIG. 3 shows a kit containing an assemblage of a third embodiment the invention.
Figure 6:
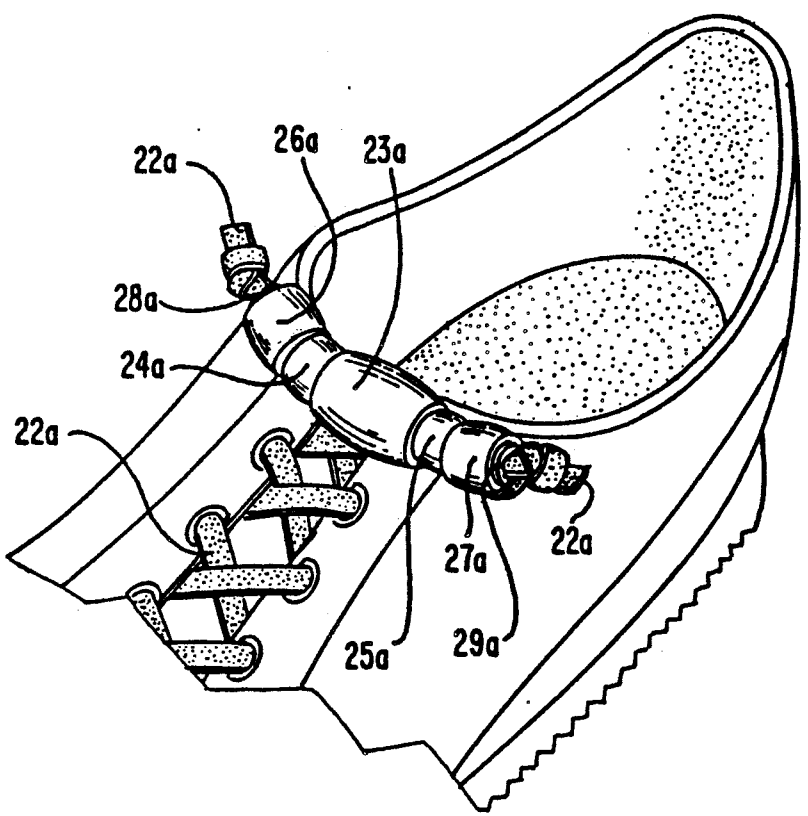
FIG. 6 shows the elements of FIG. 3 installed in one of a pair of conventional sneakers, partially broken away.

A third type of embodiment is shown in FIGS. 3 and 3A, the package being similar to package 1 in FIG. 1. This embodiment comprises a pair of elastic laces 22*a*, 22*b*, and two sets of decorative beads, of which, for clarity only, one set, identified by letter a, will be described and a similar set for the other sneaker being 25 identified by letter b. The decorative beads include a central bead or ferrule 23*a*, which is ¾ inch long. The contour in a length direction is slightly rounded, having an outer diameter at the ends which varies from ⅜ inch to about ⅝ inch at the center, with an axial bore having a diameter of about ¼ inch. Adjacent each of the ends of central bead 23*a* is a small cylinrical bead 24*a*, 25*a*, about 5/16 inch long and ⅜ inch in outer diameter, with an inner axial bore, say, 3/16 inch in diameter. Adjacent each of the outer ends of 24*a* and 25*a* is a slightly larger bead, 26*a*, 27*a* which extends 7/16 inch along the axis, and is slightly rounded in contour from a diameter of 7/16 inch at the ends. These have internal axial bores of 5/16 inch. The beads 23*a*, 24*a*, 25*a*, 26*a* and 27*a*, and their counterparts indicated by the letter b, may be made of wood, plastic, or other solid material. Adjacent each of the ends of beads 26*a* and 27*a* are rings 28*a* and 29*a*, which, with their counterparts 28*b* and 29*b* are of brass or other metal, ⅜ inch in outer diameter and ¼ inch in inner diameter. As shown in FIG. 3A and FIG. 6, the two ends of lace 22*a* are first laced up in the shoe in normal fashion, and then threaded through the bores of the beads 26*a*, 24*a*, 23*a*, 25*a*, and 27*a* in one direction and through the same series in the opposite directions, the protruding terminal ends of the lace being then knotted around the rings 28*a* and 29*a*, the knots being concealed in the openings of the end beads. A similar procedure is employed on the other shoe with lace 22*b* and the similar set of beads, indicated by the letter b.

An alternative to buying a kit and installing the decorative fastenings and elastic laces as described in the foregoing paragraphs is for a potential user of the invention to purchase a shoe or sneaker in which the elastic laces and decorative fastenings have already been installed, as shown in FIGS. 3, 4 and 5.

It will be understood that the present invention is not limited to the details described by way of example in the embodiments shown and described herein, but only by the scope of the appended claims.

What I claim is:

1. A kit comprising decorative fastening means for laces in shoes in combination with an elastic shoelace having two ends;

said fastening means comprising a rigid flat member having substantially parallel surfaces;

at least one opening drilled through the thickness of said flat member for accommodating the ends of said lace threaded through said openings in opposite directions;

a pair of ring-shaped members contructed to be disposed in spaced-apart relation from opposite ends of said openings for accommodating the ends of said shoelaces threaded through said openings in opposite directions for knotting or otherwise securing around said ring-shaped members, wherein said rigid flat member and said pair of ring-shaped members are constructed to be disposed as ornamentation against the upper surface of said shoes.

2. A kit comprising decorative fastening means for laces in shoes in combination with an elastic shoelace;

said fastening means comprising:

ferrule means having at least one axially-disposed longitudinal channel;

a pair of ring-shaped members constructed to be disposed in spaced-apart relation from opposite ends of said channel;

wherein said elastic shoelace has two ends, both of which ends are constructed to be threaded through the channel in said ferrule from opposite directions;

each of said ends, after being threaded through said ferrule, constructed to be knotted around or otherwise secured in said respective ring-shaped members, wherein said ferrule means and said ring-shaped members are constructed to be disposed as ornamentation against the upper surface of said shoes.

3. A kit in accordance with claim 2 wherein at least one end is interposed between each of the ends of said ferrule means and each said ring-shaped member.

* * * * *